United States Patent [19]

Mitchell

[11] 4,389,300

[45] Jun. 21, 1983

[54] SOLVENT EXTRACTION METHOD

[75] Inventor: David S. Mitchell, San Rafael, Calif.

[73] Assignee: Chevron Research Company, San Francisco, Calif.

[21] Appl. No.: 79,300

[22] Filed: Sep. 26, 1979

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 2,965,557 | 12/1960 | Price | 208/11 LE |
| 3,070,541 | 12/1962 | Price | 208/11 LE |
| 3,131,141 | 4/1964 | West | 208/11 LE |
| 3,475,318 | 10/1969 | Gable et al. | 208/11 LE |
| 3,617,464 | 11/1971 | Johnson | 208/8 LE |
| 3,875,046 | 4/1975 | Rosenbloom | 208/11 LE |
| 4,189,376 | 2/1980 | Mitchell | 208/11 LE |

*Primary Examiner*—Charles F. Warren
*Assistant Examiner*—Joseph A. Boska
*Attorney, Agent, or Firm*—D. A. Newell; S. R. LaPaglia; J. W. Ambrosius

[57] ABSTRACT

A method for solvent extracting extractable materials from solids is disclosed, which includes (a) maintaining a vertically extending bed comprising said solids in a vertically extending extraction zone and introducing said mixture into an upper portion of said bed; (b) providing a substantially continuous gaseous phase in contact with a lower portion of said bed; (c) maintaining a substantially continuous liquid phase comprising a vaporizable primary liquid solvent and at least one secondary liquid solvent in contact with at least a lower part of said upper portion of said bed above said gaseous phase, said liquid phase and said gaseous phase having an interface at a vertically intermediate level of said bed; (d) introducing said primary liquid solvent into an intermediate liquid level in said liquid phase spaced from the top of said liquid phase; (e) introducing at least one secondary liquid solvent into said liquid phase above said intermediate liquid level; (f) passing said primary and secondary solvents through said liquid phase, extracting said extractable component from said mixture into said liquid phase, and removing said extractable component and said solvents from said extraction zone; (g) preventing said liquid phase from flowing downwardly through said lower portion of said bed by maintaining said gaseous phase at a pressure sufficient to support said liquid phase thereon and vaporizing said primary solvent adhering to solids in said lower portion of said bed; and (h) removing solids from said lower portion of said bed.

8 Claims, 3 Drawing Figures

SOLVENT EXTRACTION METHOD

BACKGROUND OF THE INVENTION

The present invention relates to a process for solvent extraction of solvent-extractable materials from a mixture including subdivided solids.

A variety of solvent-extractable materials are recovered from admixture with subdivided solids by solvent-extraction processes. For example, hydrocarbons and hydrocarbonaceous oils may be recovered from association with hydrocarbon-containing solids such as tar sands, oil shale and the like, and can be used as a substitute or supplement for petroleum and petroleum derivatives. One key factor in solvent extraction of large amounts of hydrocarbons from solids is the economical recovery of solvent from the residual solids.

One tar sand solvent-extraction process previously proposed involves mixing a solvent with the tar sand and then draining off the solvent and extracted hydrocarbons (bitumen). After being drained off, bitumen and solvent are then separated by fractionation. The bitumen is normally subjected to further conventional refining. After the bitumen and solvent have been drained from the solids, the solids are treated to remove any adhering solvent by steam stripping. Each extraction and drain stage can include countercurrent washing of the solids with solvent.

In U.S. Pat. No. 3,475,318, it is proposed to solvent-extract tar from tar sands using aliphatic hydrocarbons having 5 to 9 carbon atoms or mixtures of such aliphatics with up to 20% of aromatics having 6 to 9 carbon atoms. The tar sand is broken down into particles of a size between 0.03 and 0.25 inch diameter before solvent extraction. Solvent is passed over a bed of tar sand formed on a filter. The solid and tar are separated from the solvent residue by filtration. After filtration, the solids are stripped of volatiles with steam, which is employed at a rate of 3–21 pounds per 100 pounds of sand for a time of 0.5 to 3 minutes. Solvent is recovered by decantation from the subsequently condensed steam.

In U.S. Pat. Nos. 3,573,195 and 3,573,196 it is proposed to extract bitumen from bituminous sand by mixing the sand with water and hydrocarbon diluent containing dissolved normally gaseous ($C_1$–$C_3$) hydrocarbons, at a temperature of less than 110° F. and then introducing the resulting mixture into a body of water maintained at a temperature above 150° F. The normally gaseous hydrocarbons come out of solution and float the bitumen to the surface of the water for recovery. The hydrocarbon diluent is recovered by decantation from the water.

U.S. Pat. No. 3,875,046 discloses a solvent-extraction process using a single vertically extending extraction vessel. Downwardly flowing particulate tar sand is fluidized by an upwardly flowing liquid mixture of water and hydrocarbon solvent. The hydrocarbon solvent is selected to boil at a temperature below the boiling point of water. Steam is introduced into an intermediate level of the vessel to scour the solvent from the residual sand. Solvent is introduced above the steam introduction point, and water is introduced below the steam introduction point. Solvent condenses on the cooler sand higher up in the bed. The tar and hydrocarbon solvent are separated from water above the top of the tar sand bed by decantation and the solvent phase and water phase are removed. The water introduced into the lower end of the bed contains agglomerated fines. The wet, stripped sand is removed from the bottom of the vessel. The amount of hydrocarbon solvent employed is preferably that sufficient to control the viscosity of the tar recovered. The problem of solvent recovery is discussed. That is, this patent recognizes that a practical process for solvent extraction of hydrocarbon-containing solids necessarily must include some more-or-less effective means for recovering the organic solvent from the residual solids before the solids are discarded. The more solvent that is lost with the solid residues, the less economical will be a given solvent-extraction process.

The extraction of hydrocarbonaceous materials from coal and oil shale is known in the art. For example, U.S. Bureau of Mines Bulletin No. 635, entitled "Development of the Bureau of Mines Gas-Combustion Oil-Shale Retorting Process", by Arthur Matzick et al, refers on page 10 to the benzene-soluble material in oil shale, and refers on page 12 to the partial solubility of the organic material of oil shale in organic solvents. A textbook entitled "Chemistry of Coal Utilization", edited by H. H. Lowry, published by John Wiley & Sons, Inc., states on page 237, "Extraction of coal by solvents has been for many years a method used for studying the constitution of coal and for producing products of potential industrial value". Pages 239–240 refer to the extraction of low rank coal with primary aliphatic amines, and coal extraction with benzene, pyridine, phenols, aromatic hydrocarbons, aliphatic hydrocarbons, alcohols, ketones, etc. Page 243 states that ethylenediamine extracts material from coal at room temperature. The teachings of the two last-mentioned publications are incorporated herein by specific reference. Single solvents for bitumen are often overly selective for fractions of bitumen, whereas it is advantageous to extract as much hydrocarbonaceous material as possible from the sand. For example, lighter hydrocarbon solvents tend to extract the lighter bitumen fractions selectively, leaving potentially valuable hydrocarbonaceous materials, such as asphaltenes, in the residue.

U.S. Pat. No. 3,117,922 discloses a bitumen recovery operation in which tar sand is first extracted with a higher-boiling hydrocarbon solvent on a moving filter belt and then washing the residual solids with a lower-boiling hydrocarbon solvent. U.S. Pat. No. 3,131,141 discloses contacting tar sand with a gas oil solvent and further contacting the residue with a liquefied, normally gaseous hydrocarbon solvent.

U.S. Pat. Nos. 4,071,433 and 4,071,434 disclose the combination of bitumen coking, bitumen separation by fractionation and extraction of bitumen from bituminous sand.

SUMMARY OF THE INVENTION

In a broad embodiment, the invention relates to a method for solvent-extracting an extractable component from a mixture including the extractable component and subdivided solids, comprising the steps of: (a) maintaining a vertically extending bed comprising the solids in a vertically extending extraction zone and introducing the mixture into an upper portion of the bed; (b) providing a substantially continuous gaseous phase in contact with a lower portion of the bed; (c) maintaining a substantially continuous liquid phase comprising a vaporizable primary liquid solvent and at least one secondary liquid solvent in contact with at least at lower part of the upper portion of the bed above the gaseous phase, the liquid phase and the gaseous phase having an interface at a vertically intermediate level of the bed; (d) introducing the primary liquid solvent into an intermediate liquid level in the liquid phase spaced from the top of said liquid phase; (e) introducing at least one secondary liquid solvent into the liquid phase above the intermediate liquid level; (f) passing the primary and secondary solvents through the liquid phase, extracting the extractable component from the mixture into the liquid phase, and removing the extractable component and the solvents from the extraction zone; (g) preventing the liquid phase from flowing downwardly through the lower portion of the bed by maintaining the gaseous phase at a pressure sufficient to support the liquid phase thereon and vaporizing the primary solvent adhering to solids in the lower portion of the bed; and (h) removing solids from the lower portion of the bed.

In a more specific embodiment, a method is disclosed for solvent-extracting bitumen from bituminous sand, comprising: (a) maintaining a vertically extending bed of bituminous sand in a vertically extending extraction zone and introducing bituminous sand into an upper portion of the bed; (b) providing a substantially continuous gaseous phase in contact with a lower portion of the bed; (c) maintaining a substantially continuous liquid phase comprising a vaporizable primary liquid solvent and at least one secondary liquid solvent in contact with at least a lower part of the upper portion of the bed above said gaseous phase, the liquid phase and the gaseous phase having an interface at a vertically intermediate level of the bed; (d) introducing the primary liquid solvent into an intermediate liquid level in the liquid phase space from the top of the liquid phase; (e) introducing at least one secondary liquid solvent into the liquid phase above the intermediate liquid level; (f) passing the primary and secondary solvents through the liquid phase, extracting bitumen from the bituminous sand into the liquid phase, and removing the resulting extracted bitumen and the solvents from the extraction zone; (g) preventing the liquid phase from flowing downwardly through the lower portion of the bed by maintaining the gaseous phase at a pressure sufficient to support the liquid phase thereon and vaporizing the primary solvent adhering to solids in the lower portion of the bed; and (h) removing solids from the lower portion of the bed.

As discussed in my copending application, Ser. No. 909,890, filed on May 26, 1978 now U.S. Pat. No. 4,189,376, the complete disclosure of which is hereby incorporated in this specification, bitumen can be efficiently extracted from bituminous sand in a single vessel with extremely small solvent losses in the inorganic residue. By (1) heating a lower portion of a bed of solids to strip solvent from the solids, and (2) maintaining a substantially continuous gaseous atmosphere in contact with the solids in the lower portion of the bed, a substantially continuous liquid solvent phase can be maintained above the gaseous phase, supported on the gaseous phase. Liquid solvent entering the gaseous phase absorbed in solids is vaporized and stripped off the solids. Vaporized solvent returns to the liquid phase higher in the vessel and condenses. The bed of tar sand is either continuously moved downward or alternately held static and moved downward. As disclosed in Ser. No. 909,890, the solvent can be conveniently vaporized stripped off sand in the lower portion of the bed and a substantially continuous gaseous atmosphere can be maintained at the desired pressure by introducing steam into the lower portion of the bed. When using steam as a vaporizing and stripping medium and as a gaseous-phase-forming medium, the solvent is preferably selected to have a boiling point below that of water at the pressure used.

I have now found that two or more different solvents can advantageously be used simultaneously in my extraction system. A primary solvent, which must be vaporizable and is preferably a light, normally liquid material having a normal boiling point below about 100° C., is introduced into the extraction system at a relatively lower level, and a secondary solvent, which need not be vaporizable and is preferably a heavier, higher boiling material, is introduced into the extraction system at a relatively higher level. When extracting bitumen from bituminous sand, for example, the present invention provides particularly efficient extraction of heavy, asphaltenic components of the bitumen by use of an aromatics-rich secondary solvent, such as a gas oil fraction.

Further objects, embodiments and advantages of the present invention will be apparent from the following description of the drawings and detailed description of the invention.

THE DRAWINGS

In the attached drawings, FIGS. 1 and 3 show schematic views of bituminous sand solvent-extraction systems employing preferred embodiments of the present invention, and FIG. 2 shows a side sectional view of a part of the system shown in FIG. 1.

Referring to FIG. 1, there is shown a vertically extending solvent extraction zone such as a vessel or column 1, into an upper portion of which is fed an intimately associated mixture of an extractable material and subdivided solids, e.g., bituminous sand, by a conduit 3, connected to a supply hopper 5. The bituminous sand is conveyed from the hopper 5 into the vessel 1 by a screw-feed mechanism (not shown) located within the conduit 3 and driven by a motor 7. The feed mechanism may be operated continuously or intermittently. A light, vaporizable primary solvent, such as a $C_5$–$C_6$ hydrocarbon fraction, is introduced as a liquid into an intermediate liquid level in a vertically elongated portion 9 of the column 1 through a plurality of radially spaced inlets 11, each of which is connected to a feed manifold 12. A heavier secondary solvent, such as a gas oil boiling range hydrocarbon fraction having a boiling range of 85° to 600° C., preferably 90° to 320° C., is introduced into the vessel 1 through a plurality of radially spaced inlets 13, each connected to a feed manifold 14. The upper end of a bed 15 comprising subdivided solids is maintained below the level of the inlet from conduit 3 and above the level of the solvent inlets 13. The vessel 1 includes a larger-diameter clarifying section 17 at its top end, to allow liquid containing a mixture of solvents and extracted bitumen to be decanted, for separation from entrained fine solids, before the extract liquid is removed from the top of the clarifying section through an outlet conduit 19. Steam is introduced into the column 1 through a plurality of radially spaced inlets 21, each of which is connected to a steam feed manifold 23. Stripped residual solids are removed from the bottom of the column 1 through a conduit 25. The residual solids are conveyed from the column by a screw conveyor 27 (see FIG. 2) which is driven by a motor 29. The conveyor 27 may be operated continously or intermittently. Referring to FIG. 2, a substantially continuous gaseous phase designated generally by the number 31 is maintained in contact with a lower portion of the bed 15 below the solvent inlet 11. A substantially continuous liquid phase, designated generally by the number 33, is maintained in contact with an upper portion of the bed 15 above the gaseous phase 31 with the liquid phase being supported on the gaseous phase. The top of the liquid phase is indicated generally by a line at 34. A liquid-gas interface between the liquid phase 33 and the gaseous phase 31 at an intermediate level of the solids bed is indicated by a line at 35. Referring again to FIG. 1, the outlet conduit 19 conveys a mixture of extracted bitumen and solvent to a separation zone 37, which may include fractionation and distillation means, means for dividing or consolidating streams or fractions, and/or other conventional separation means. In the separation zone, a $C_5$–$C_6$ fraction having a 70°–90° C. boiling range, is separated and an appropriate amount is passed into a conduit 39 to be used in solvent extraction as described above. A higher boiling, relatively aromatic 90°–260° C. boiling range fraction is separated and an appropriate amount is passed into a conduit 41 for use in solvent extraction. Hydrocarbonaceous products are recovered from the separation zone through a conduit 43. It will be apparent that a plurality of hydrocarbonaceous products, such as different boiling range hydrocarbon fractions, may be separately recovered. A single recovery conduit is shown merely for simplicity. A heavy hydrocarbon fraction, such as a residual fraction, is passed from the separation zone through a conduit 45 into a hydrocarbon conversion zone 47. In the conversion zone at least part of the high-boiling material is converted to distillable, valuable hydrocarbons by conventional conversion means such as coking means, catalytic cracking means, hydrocracking means, or the like. The partially or wholly converted material is returned to the separation zone 37 from the conversion zone 47 through a conduit 49 for separating lower boiling or other desired components of the conversion zone effluent.

Referring to FIG. 3, there is shown a vertically extending solvent extraction zone such as a vessel or column 101, into an upper portion of which is fed an intimately associated mixture of an extractable material and subdivided solids, e.g., bituminous sand, by a conduit 103, connected to a supply hopper 105. The bituminous sand is conveyed from the hopper 105 into the vessel 101 by a screw-feed machanism (not shown) located within the conduit 103 and driven by a motor 107. The feed mechanism may be operated continously or intermittently. A light, vaporizable primary solvent, such as a $C_5$–$C_6$ hydrocarbon fraction, is introduced as a liquid into an intermediate liquid level in a vertically elongated portion 109 of the column 101 through a plurality of radially spaced inlets 111, each of which is connected to a feed manifold 112. A heavier solvent, such as a gas oil boiling range hydrocarbon fraction having a boiling range of 85° to 600° C., preferably 90° to 320° C., is introduced into the vessel 101 through a plurality of radially spaced inlets 113, each connected to a feed manifold 114. The upper end 115 of a bed 116 comprising subdivided solids is maintained below the level of the conduit 103 and above the level of the solvent inlets 113. The vessel 101 includes a larger-diameter clarifying section 117 at its top end, to allow liquid containing a mixture of solvents and extracted bitumen to be decanted, for separation from entrained fine solids, before the extract liquid is removed from the top of the clarifying section through an outlet conduit 119 and a lower outlet conduit 120 located between the solvent inlets 113 and 111. Steam is introduced into the column 101 through a plurality of radially spaced inlets 121, each of which is connected to a steam feed manifold 123. Stripped residual solids are removed from the bottom of the column 101 through a conduit 125. The residual solids are conveyed from the column by a screw conveyor (not shown) which is driven by a motor 129. The conveyor may be operated continuously or intermittently. A substantially continuous gaseous phase is maintained in contact with a lower portion of the bed 116 below the solvent inlet 111 (in a manner the same as shown in FIGS. 1 and 2). A substantially continous liquid phase is maintained in contact with an upper portion of the bed 116 above the gaseous phase with the liquid phase being supported on the gaseous phase. The top of the liquid phase is indicated generally by a line at 134. A liquid-gas interface is maintained between the liquid phase and the gaseous phase at an intermediate level of the solids bed. The upper outlet conduit 119 and the conduit 120 to the conduit 119 convey mixtures of extracted bitumen and light and heavy solvent to a separation zone 137, which may include fractionation and distillation means, means for dividing or consolidating streams or fractions, and/or other conventional separation means. In the separation zone, a $C_5$–$C_6$ fraction having a 70°–90° C. boiling range, is separated and an appropriate amount is passed into a conduit 139 to be used in solvent extraction as described above. A higher boiling, relatively aromatic 85°–600° C., preferably 90°–320° C., boiling range fraction is separated and an appropriate amount is passed into a conduit 141 for use in solvent extraction. Hydrocarbonaceous products are recovered from the separation zone through a conduit 143. It will be apparent that a plurality of hydrocarbonaceous products, such as different boiling range hydrocarbon fractions, may be separately recovered. A single recovery conduit is shown merely for simplicity. A heavy hydrocarbon fraction, such as a residual fraction, is passed from the separation zone through a conduit 145 into a hydrocarbon conversion zone 147. In the conversion zone at least part of the high-boiling material is converted to distillable, valuable hydrocarbons by conventional conversion means such as coking means, catalytic cracking means, hydrocracking means, or the like. The partially or wholly converted material is returned to the separation zone 137 from the conversion zone 147 through a conduit 149 for separating lower boiling or other desired components of the conversion zone effluent.

DETAILED DESCRIPTION OF THE INVENTION

Figure 1:
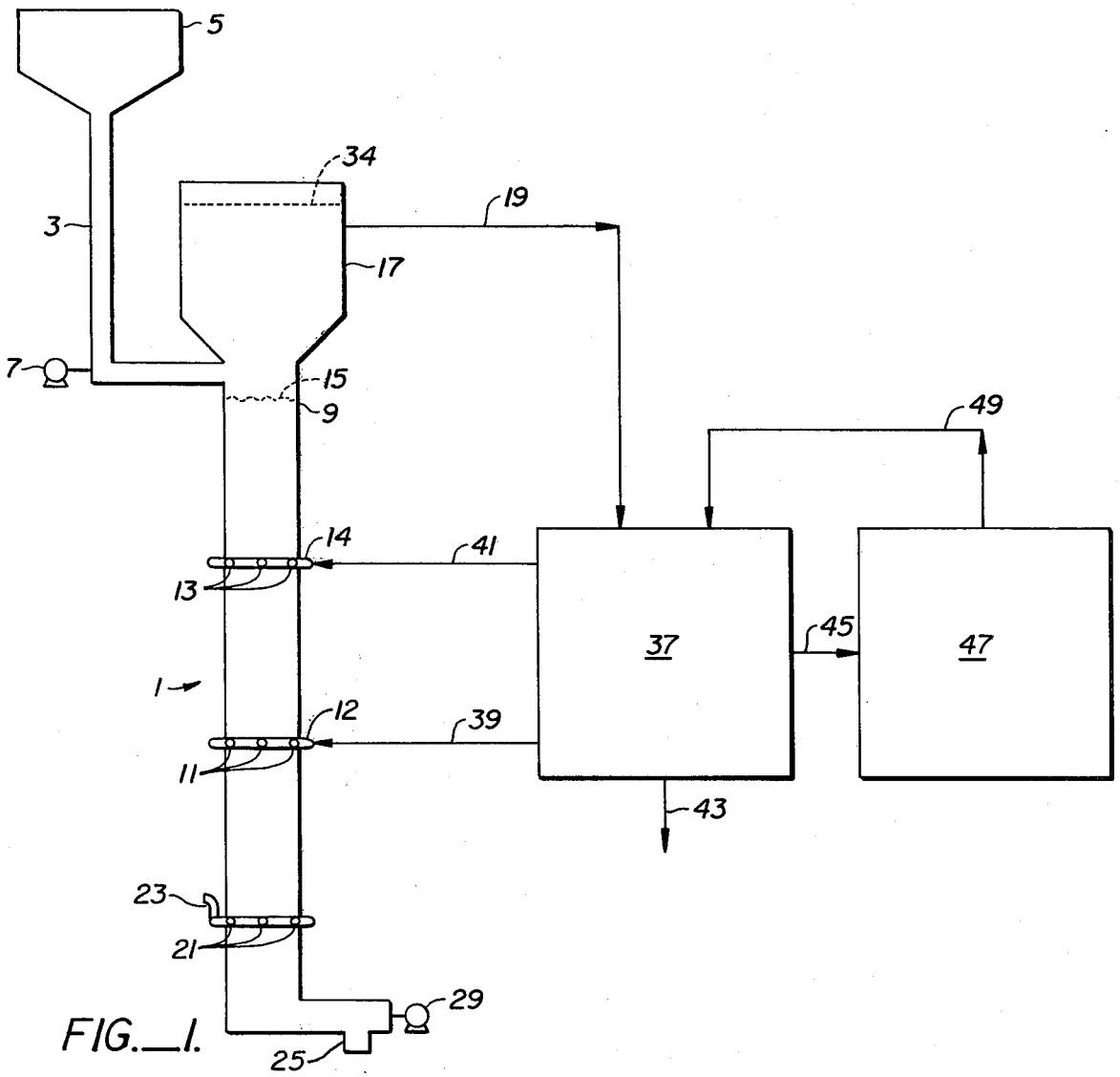

In general, the present solvent extraction method is useful for recovering solvent-extractable components associated with subdivided, substantially non-extractable solids. The solubility, in any solvent, of any particular extractable component which it is desired to separate from intimate association with subdivided solids will, of course, depend on the particular solvent, or mixture of solvents, used. In operation of the present method it is required that at least one of the solvents (herein termed the "primary" solvent) be vaporizable and that at least one solvent is capable of extracting at least a portion, e.g., at least one weight percent, of the extractable component from a mixture including the extractable component and the subdivided solids. Taking these restrictions into account, it will be within the ability of those skilled in the art to select appropriate solvents for extracting a particular extractable component to separate it from association with non-extractable subdivided solids. When a material to be subjected to extraction is not found in a desired size range, the desired size range may be obtained, if necessary, by conventional grinding, milling, crushing or like procedure. Conventional, solvent extraction typically involves recovering a solvent-extractable organic component from intimate association with insoluble organic or inorganic subdivided solids. An organic solvent is often employed. The choice of solvent is normally made to optimize recovery of the particular desired extractable organic component.

Examples of mixtures of a solvent-extractable component intimately associated with subdivided solids are seeds such as cottonseed, soybeans, flax seed, etc., in which the cottonseed oil, soy oil and linseed oil are the extractable components, with the subdivided solids being composed primarily of organic cellulosic material.

According to a preferred embodiment, the present method is particularly adapted for use in solvent extracting extractable hydrocarbonaceous components, e.g., bitumen, referred to generally herein as "hydrocarbons", from tar sands (bituminous sands), oil shale, coal, lignite, and the like, which contain a mixture of extractable hydrocarbonaceous components and subdivided, insoluble, inorganic solids. The present method is particularly adapted for use in extracting extractable liquid or liquefiable hydrocarbonaceous materials, normally termed "tar" or "bitumen", from the naturally occurring mixtures of tar, or bitumen, and inorganic sand known as tar sands or bituminous sands. Deposits of such hydrocarbonaceous sands are found at several places in the United States, Canada and at various other locations. The extractable component in bituminous sand, as well as readily appreciated by those skilled in the art, often includes oxygenated, nitrogenated, and other hetero-type organic compounds in addition to compounds which can be strictly classified as hydrocarbons.

The method of the invention may most conveniently be carried out in any type of vertically extending confined space, such as an extraction zone or vessel formed by a vertical pipe, conduit, chamber, etc. Generally, any type of conduit or chamber is suitable, providing that it is adapted to hold a vertically extending bed of the material to be solvent extracted and is adapted to contain the liquid solvents and a heated gaseous atmosphere at temperatures and pressures employed. A variety of conduits, chambers, reactors and the like which are suitable for use to provide an extraction zone or vessel employed in the present extraction method will be readily apparent to those skilled in the art.

In carrying out the method of the invention, a mixture of non-extractable subdivided solids and a solvent-extractable component in intimate association is passed into the upper portion of the extraction zone, and a bed comprising the non-extractable solids is maintained in the extraction zone. Preferably the solids are maintained in the extraction zone as a packed bed. Thus, solids higher up in the bed are preferably at least partially supported by solids lower in the bed, rather than solids being ebullated or fluidized by liquid or gaseous materials in the extraction zone. In one mode of operation, the bed is preferably maintained with particles substantially continuously moving downwardly through the extraction zone. In this mode, the particles preferably move downwardly in substantially plug flow. It will be appreciated that in a bed with a relatively large horizontal cross-sectional area, different portions of the bed may be moving downwardly at somewhat different rates, even when a packed bed is used. Materials to be solvent extracted may be introduced into the bed and residual solids may be removed from the bed, continuously or periodically or at any convenient time, in any convenient manner, e.g., by a screw conveyor, star feeder, rotating grate, etc. Preferably, when residual solids are removed from the bed, so that plug-type flow of solids downwardly through the vertical extraction zone is facilitated. Plug-type solids flow using a packed bed of solids is particularly advantageous in the present method, in that fewer fine solids are entrained in the moving liquid solvent and extracted material. It will be understood that, while the bed comprises primarily the non-extractable solids, the bed may also include unextracted fractions of the extractable component. This is particularly so closer to the upper end of the bed, and in cases where the extractable component is solid or semi-solid prior to extraction.

In another mode of operation, the bed is preferably alternately moved downwardly and held substantially static. The length of time the bed is held static and the length of time the bed moves downward in the alternating moving-static mode can be varied to permit optimum extraction of the extractable component in the liquid phase and to permit optimum removal of vaporizable solvent liquids from the residual solids in the gas phase. Preferably, the alternating of downward movement and holding stationary can be carried out in a periodic manner, but such is not necessary. In some cases, the pressure of the gas phase is sufficient to impede or halt the downward movement of the bed. In such cases, the pressure can be alternately increased and decreased, with the bed moving downward during the lower pressure periods and remaining static during the higher pressure periods. In the higher-lower pressure mode, the interface between the gas phase and the liquid phase can be made to move higher in the bed during the higher pressure, stationary bed periods, and when the pressure is decreased and the bed moves downward, then the interface between the gas phase and the liquid phase also moves downward, in some cases at a faster rate than the bed. In embodiments using steam to provide the gas phase, the flow of steam can be alternately increased and decreased or alternately turned on and off, whereby the movement of the bed and the vertical level of the gas-liquid interface can be controlled.

Further in carrying out the invention, at least two different solvents are introduced into at least two vertically spaced levels in an upper portion of the bed of solids above the gaseous phase. The lowest vertical level at which solvent is introduced should be sufficiently spaced from the bottom of the bed to provide space for formation of a gaseous phase below the lowest solvent introduction level and to allow space sufficient for vaporization and separation of any adhering solvent from the solids below the lowest solvent inlet. The highest vertical level at which a solvent is introduced should be sufficiently spaced from a liquids outlet to allow effective contact between solvents and solids in the upper portion of the bed for good extraction.

The best primary and secondary solvents for use in any particular case can be selected by one skilled in the art according to the type of extractable component to be extracted in the given case. One of the solvents, the primary solvent, must be vaporizable to permit its use and should have a normal boiling point below at most 150° C., and preferably below 100° C. The other solvent or solvents, herein termed the "secondary" solvents, need not be vaporizable, but two or more vaporizable solvents may be used, if desired, as the primary and secondary solvents. Preferably, the higher-boiling of the two solvents is introduced at a relatively higher vertical level of the solids bed. Representative of generally suitable solvents for use as either a primary solvent or a secondary solvent (the primary solvent also being selected to be vaporizable at the operating conditions employed), are: hydrocarbons, including, for example, $C_4$–$C_{10}$ or higher aliphatics such as pentanes, hexanes, heptanes, octanes, olefins and cycloolefins such as methylcyclopentene, naphthenes such as cyclopentane, cyclohexane alkylcyclohexanes, as well as $C_6$–$C_{10}$ or higher aromatics such as benzene, toluene, xylenes, ethylbenzene, $C_4$-600° C. and preferably $C_4$-320° C. boiling petroleum fractions such as naphthas, gasoline fractions, etc., especially vaporizable fractions such as 40°–90° C. fractions, $C_4$-600° C. and preferably $C_4$-320° C. synthetic hydrocarbon fractions such as may be derived from coking, cracking, fractionation, pyrolysis, gasification, liquefaction or extraction of tar sand, coal, oil shale and the like, especially vaporizable fractions such as synthetic 40°–90° C. fractions, halogen-substituted hydrocarbons such as carbon tetrachloride, chloroform, trichlorofluoromethane, ethyl chloride, ethylene dichloride, methylene chloride, perchloroethylene, trichloroethylene; alcohols such as methanol, ethanol, isopropanol, butanol, pentanol, hexanol, etc., phenol, alkylphenols; esters such as methyl acetate, ethyl acetate isopropyl acetate, butyl acetate, vinyl acetate; ketones such as acetone, methyl ethyl ketone, ethers such as tetrahydrofuran; carbon disulfide; dimethylformamide; polyols, glycol ethers, etc.

It is especially to be noted that mixtures of two or more of the solvents or classes of solvents discussed above may often be advantageously mixed and introduced together at a single vertical level of the extraction bed to provide either the primary solvent, the secondary solvent, or both, in carrying out the present invention. For example, mixtures of aromatic and aliphatic hydrocarbons, or mixtures of alcohols with hydrocarbons, such as phenol-benzene mixtures, are quite suitable.

Surface-active agents, whether termed "surfactants", "wetting agents", etc., can be employed in the present method. For example, a surfactant can be mixed with one or both of the solvents to enhance the solvent properties or to enhance removal of organic liquids from pores of nonextracted solids. Suitable surface-active agents can be, for example, inorganic hydroxide salts, carboxylic acids, sulfuric esters, alkane sulfonic acids and salts, alkylaromatic sulfonic acids and salts, organic and inorganic ammonium salts, alkali metal silicates, phosphoric acids and salts, amine salts, and the like. Specific examples of suitable surface-active agents are sodium laural sulfate, polyoxyethylene alkylphenols, dodecyl trimethyl ammonium chloride, alkylaryl naphthenic sulfonate, tetrasodium pyrophosphate, sodium tripolyphosphate, potassium pyrophosphate and sodium silicate, sodium carbonate, alkali metal hydroxides, and alkaline earth metal hydroxides.

Emulsion-breaking components may also be used in the system, as by combining them with one or both of the solvents in an effective amount. Examples of suitable de-emulsifiers include polyethoxyalkylene, diethyl ethanolamine, polyols, and polyoxypropylene glycols.

Solvents which are insoluble (or immiscible) or only slightly soluble (or only slightly miscible) in water are preferred. Preferably, vaporizable primary solvents used in the process have normal boiling points or normal end boiling points below the normal boiling point of water. A preferred primary solvent is a hydrocarbon fraction having a normal boiling range of 40° C. to 90° C. Hexane and cyclohexane are very suitable as to boiling point. In one preferred embodiment, the normal boiling point or normal end boiling point of the vaporizable primary solvent is at least 15° C. below the normal boiling point of water. Preferably the primary solvent employed in extracting bituminous sand has a specific gravity of less than 1.0.

In a preferred embodiment of the present invention for solvent extraction treatment of bituminous sands and the like, specific preferred primary solvents include pentanes, hexanes, benzene, cyclopentane, cyclohexane and methylcyclopentane, and $C_5$–$C_6$ olefins and cycloolefins, and particularly mixtures of two or more of the above in any proportions. Hydrocarbon fractions having a boiling range between about 35° C. and about 95° C., particularly preferably between 40° C. and 90° C., such as $C_5$–$C_7$ petroleum fractions available in petroleum refineries, or hydrocarbon fractions derived from coal, tar sand oil, etc., are particularly preferred primary solvents.

Likewise preferred secondary solvents for solvent extraction of bituminous sands are hydrocarbon fractions containing at least one hydrocarbon having a normal boiling point in the range from 85° to 600° C., preferably 95° C. to 320° C., such as $C_7$–$C_{12}$ hydrocarbons and hydrocarbon fractions. Preferably, the secondary solvent includes a substantial content of aromatic hydrocarbons, especially preferably at least 25 weight percent aromatic hydrocarbons. Specific preferred secondary solvents include toluene, xylenes, ethylbenzene and homologous alkylaromatics, condensed aromatics such as naphthalene and the like.

Suitable primary and secondary solvents may, in many cases, be provided in whole or in part from extracted hydrocarbons obtained in the present extraction operation from tar sands or the like. Suitable solvents material may, for example, be obtained by separation operations such as fractionation, or by hydrocarbon conversion operations such as coking, catalytic cracking, hydrocracking and/or other conventional conversion treatment of the extracted bitumen. Such bitumen-derived solvents may, of course, be enhanced by the addition of other solvent materials not derived by simply separating or converting bitumen.

The invention can best be further described by reference to the drawings, which depict systems for carrying out preferred embodiments of the invention. It will be apparent that the invention is not limited to the embodiments shown, and that the scope of the invention includes a variety of alternatives, modifications and equivalents of the depicted embodiment.

Referring to FIG. 1, fresh bituminous sand is introduced, either continuously or at regular or varying intervals, into the solvent extraction zone in the vessel 1 into the confined space provided by the vertically elongated section 9, by way of the conduit 3. Expended, residual sand is removed from the bottom of the section 9 through the conduit 25 either continuously or at intervals corresponding generally with the introduction of fresh bituminous sand. A bed 15 of solid bituminous sand is maintained in the vessel 1, with the top end of the bed preferably kept at a level at about the line shown at 15, sufficient fresh sand being supplied from the conduit 3 to compensate for the amount of residual sand removed by the conduit 25.

The bituminous sand is preferably introduced into the extraction system as particulate solids having a maximum average particle diameter of less than one-fourth inch. Of course, larger clumps of some tar sands may break down into particles of the desired small size when they contact the solvent, so that prior comminution is often not necessary. Preferably the tar sand is introduced with a particle size range of between 4 and 100 mesh, especially 4 to 20 mesh (Tyler Sieve Series), and particularly preferably the tar sand is introduced with a particle size range of about 4–10 mesh. The bed either continuously moves downwardly in elongated portion 9 of the column or alternately moves and remains stationary. Preferably the bed is a lightly packed bed (i.e., a loosely packed bed), in which solids, when they move downwardly, do so in substantially plug flow at a rate of about 0.01 to about 1.0 foot per minute.

Figure 2:
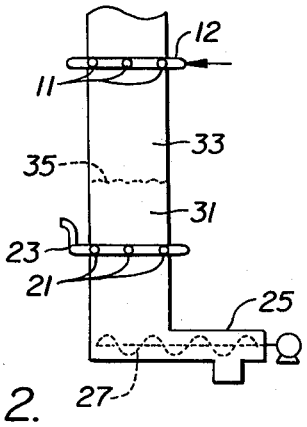

The lower portion of the bed is heated above the boiling point of the primary, vaporizable solvent and a substantially continuous gaseous phase 31 (see FIG. 2) is maintained in contact with a lower portion of the bed. That is, the gaseous phase substantially completely fills the interstitial spaces in the gaseous-phase region of the lower portion of the bed and is in contact with substantially all the solids in the gaseous-phase region of the lower portion of the bed. The solids in the lower portion of the bed can be heated by direct or indirect contact with a heating medium, and the substantially continuous gaseous atmosphere can be supplied by any suitable gas, such as nitrogen or steam. The gaseous phase preferably extends entirely across a horizontal cross-section of the extraction zone. That is, there is at least one complete horizontal cross-section in the lower portion of the extraction zone through which substantially no liquid solvent passes downwardly, with the interstices between solids in the bed being substantially completely gaseous. Preferably both the bed-heating requirement and provision of a gaseous phase in the extraction zone are accomplished by introducing steam into the extraction zone below the solvent inlet by way of the steam inlets 21. The steam is introduced at a temperature, rate and pressure sufficient to maintain a substantially continuous gaseous phase in contact with the lower portion of the bed and to support upon the gaseous phase a substantially continuous liquid phase 33 comprising the solvents, which is in contact with the upper portion of the bed above the gaseous phase. Steam is provided at a temperature and pressure sufficient to maintain a liquid-gas interface, e.g., as depicted in FIG. 2 by a line at 35. Above the interface at 35, a substantially cntinuous liquid phase is in contact with the bed, whereas below the interface at 35 a gaseous phase, comprising steam but generally including some solvent vapor, is in contact with the bed. The interstices of the solids in at least a lower part of the upper portion of the bed are substantially filled with liquid, so that the liquid phase is substantially continuous in the portion of the extraction zone holding any of the upper portion of the bed which is in contact with the solvent-containing liquid phase. Any of the vaporizable liquid primary solvent which wets or is absorbed by the solids in the bed, when they pass below the interface at 35, is vaporized rapidly. Solvent vapor in the gaseous phase is preferably returned upwardly to the liquid phase, giving off the latent heat to solids entering the gaseous phase and condensing back into the liquid phase. The amount of steam introduced need only be enough to heat the solids in the lower portion of the bed enough to vaporize solvent adhering to the solids and to support the liquid phase above the interface. The steam introduced may all condense to liquid water by the time it is removed from the system, forming a liquid-water phase. Such a water phase, if present, may be kept substantially free from solvent, since the water phase is preferably maintained at a temperature above the boiling point of the solvent, while the solvent may be prevented from entering the water phase if it is substantially immiscible with the water. In cases where a primary solvent is used which is soluble or partly soluble in water, the water phase may contain a substantial amount of solvent. Usually, the amount of liquid water formed by condensation of steam below the gaseous phase is not enough to completely fill the void spaces between the solids in the bed. Accordingly, the portion of the bed below the gaseous phase 31, may be partially in contact with liquid water and partially in contact with steam. In this case, a mixture of steam and liquid water is withdrawn along with the residual solids. Any solvent vapor mixed with this steam can then be recovered by condensing all the steam and solvent and separating the solvent from the condensate by decantation. Alternatively, the amount of heat introduced may be sufficient that substantially no water condenses in contact with the lower portion of the bed, and any water removed from the bed with the residual solids is in the form of steam. In this case, some solvent vapor is usually mixed with the steam and residual solids. The steam and solvent vapor may be condensed and any solvent can then be separated from the condensate by decantation.

In any case, it will be appreciated that a liquid, substantially continuous water-rich phase region may, in some cases, be present in contact with a bottom part of the lower portion of the bed below the gaseous phase region. Preferably, however, the gaseous phase is in contact with substantially all the solids in the lower portion of the bed, i.e., below the liquid, solvent-rich phase.

According to the invention, at least two different solvents are introduced into the extraction at two or more levels of the liquid phase. A primary, vaporizable solvent is introduced into an intermediate liquid level of the liquid phase. A secondary solvent is introduced into the liquid phase at a level vertically spaced above the intermediate liquid level at which the primary solvent is introduced. In the preferred embodiment for extraction of bituminous sand, a preferred primary solvent is a hydrocarbon fraction having a normal boiling range of 40°–90° C. The vaporizagble solvent is introduced into an intermediate liquid level in the liquid phase through the inlets 11 which introduce primary solvent into the liquid phase at a level vertically spaced from the interface 35 and also vertically spaced from the upper end 34 of the liquid phase. The exact vertical level of the liquid phase employed as the intermediate liquid level is not critical, but is preferably as close as possible to the gas-liquid interface 35, when the other essential features are taken into consideration. The preferred secondary solvent is a hydrocarbon fration, such as a coker gas oil, having a normal boiling range of 85° to 600° C., particularly preferably, 95°-320° C., containing at least 25 weight percent aromatic hydrocarbons such as, toluene, xylenes, naphthalene and the like. The secondary solvent is introduced into the liquid phase through one or more inlets located above the primary solvent inlets 11, such as the secondary solvent inlets 13 shown in FIG. 1. The secondary solvent is preferably introduced sufficiently above the primary solvent that essentially all the secondary solvent is stripped off the solids in the bed before it enters the gaseous phase.

Figure 3:
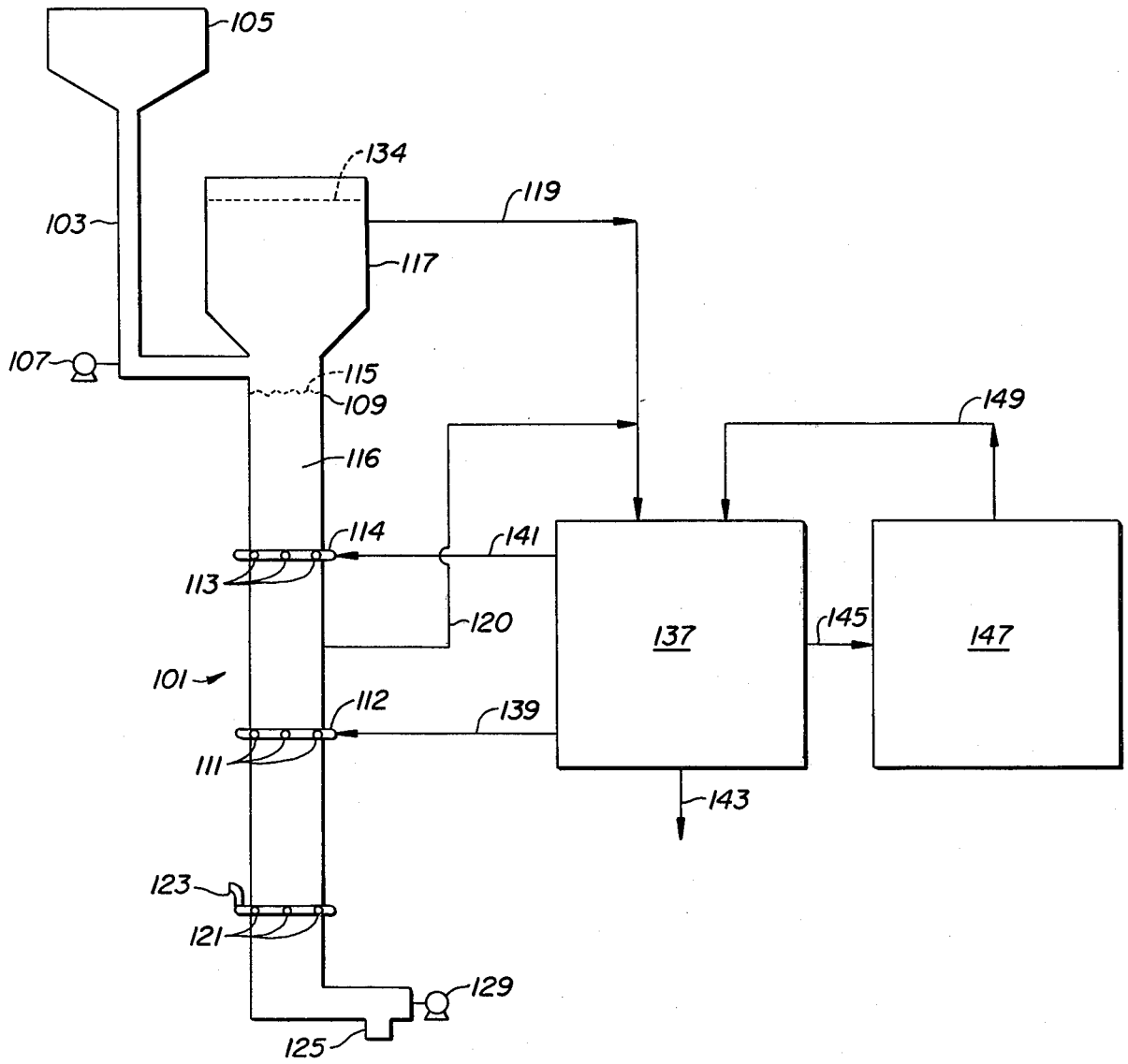

The extractable tar or bitumen is extracted from tar sand in the upper portion of the bed in contact with the liquid phase above the interface at 35 by passing the primary and secondary solvents through the upper portion of the bed. The solvents are preferably introduced into the extraction column, in the embodiment shown in FIG. 1, at rates low enough that the solids in the upper portion of the bed between the solvent inlets 11 and 13 and the bitumen solvent outlet 19, which are in contact with the liquid solvent phase, are not substantially fluidized or ebullated. In this way, the solids bed itself acts as a filter for any entrained solid fines. In the embodiment shown in FIG. 1, the primary and secondary solvents are passed upwardly through the solids bed to an outlet above the level at which the secondary solvent is introduced. This provides for efficient displacement of the secondary solvent from the extracted solids by the primary solvent before the extracted solids enter the gaseous phase. As shown in FIG. 3, the bitumen and solvents can also be withdrawn from the extraction zone from a level between the intermediate liquid level into which the primary solvent is introduced and the level into which the secondary solvent is introduced. While all the extracted bitumen and solvents can, in some cases, be withdrawn from a level between the levels at which the primary and secondary solvents are introduced, it is usually preferred to remove one portion from an intermediate level, as by the manifold 120 and the conduit 135, and another portion from above the higher solvent inlets, as by the conduit 119.

Referring again to FIG. 1, in cases where the solids to be treated may be lighter than the solvent use, as in extraction of oils from light cellulosic material, the top of the bed of solids can conveniently be maintained above the top of the liquid solvent phase in the extraction zone. In this way, a portion of the bed can be maintained submerged in the solvent phase by the pressure of solvent free solids from above. Thus, it is not critical that the solvent phase extend above the top of the bed of solids. In embodiments in which bituminous sand or other solids heavier than the solvent are to be extracted, the top of the liquid solvent phase preferably extends above the top of the bed of solids. This permits easy clarification of the liquid phase to remove solids from it before withdrawing it from the extraction zone. Thus, in the embodiment shown in the drawings, after the solvents pass upwardly above the top of the solids bed at 15, the resulting liquid mixture of extracted tar, primary solvent and secondary solvent can be clarified, if desired, in the enlarged settling section 17 of the column 1. The liquid mixture of solvents and bitumen is removed from the column from an upper portion of the liquid phase through the conduit 19 and conveyed to the separation zone 37. In the separation zone, conventional separation means are used to separate primary and secondary solvent fractions. Most of the bitumen has a higher boiling point than either solvent fraction. The solvent fractions are recycled and the higher-boiling bitumen is further processed in the conversion zone.

The temperatures and pressures used in the solvent extraction zone are not critical, except that the upper, liquid phase and the lower, gaseous phase must be maintained. The primary and secondary solvents should be at a high enough temperature to be liquid solvents and the mixture to be solvent-extracted may be at ambient temperature and pressure prior to introduction into the extraction vessel.

The extracted, residual solids, having passed downwardly through the extraction zone, into the gaseous phase, are then removed from the bottom portion of the solids bed. Preferably the solids are removed from a complete cross-section of the bed at a relatively uniform rate, so that plug-type downward flow of the bed downward through the extraction zone is maintained during solids removal.

A preferred embodiment of the present invention having been described, a large number of modifications and equivalents of the preferred embodiment will be apparent to those skilled in the art, and the scope of the invention is to be determined by the appended claims.

What is claimed is:

1. A method for extracting an extractable component from a mixture including said extractable component and subdivided solids, comprising:

(a) maintaining a vertically extending packed bed comprising said solids in a vertically extending extraction zone and introducing said mixture into an upper portion of said bed;

(b) providing a substantially continuous gaseous phase in contact with a lower portion of said bed;

(c) maintaining a substantially continuous liquid phase comprising a vaporizable primary liquid solvent and at least one secondary liquid solvent in contact with at least a lower part of said upper portion of said bed above said gaseous phase, said liquid phase and said gaseous phase having an interface at a vertically intermediate level of said bed;

(d) introducing said primary liquid solvent into an intermediate liquid level in said liquid phase spaced from the top of said liquid phase;

(e) introducing at least one secondary liquid solvent into said liquid phase above said intermediate liquid level;

(f) extracting said extractable component from said mixture into said liquid phase, and removing said extractable component and said solvents from said extraction zone;

(g) preventing said liquid phase from flowing downwardly through said lower portion of said bed by maintaining said gaseous phase at a pressure sufficient to support said liquid phase thereon and vaporizing said primary solvent adhering to solids in said lower portion of said bed; and (h) removing solids from said lower portion of said bed.

2. A method according to claim 1 wherein said primary solvent comprises at least one hydrocarbon having a normal boiling point in the range from about 40° C. to about 90° C.

3. A method according to claim 1 wherein said secondary solvent comprises at least one hydrocarbon having a normal boiling point in the range from about 95° C. to about 320° C.

4. A method according to claim 1 wherein said secondary solvent includes at least 25 weight percent aromatic hydrocarbons.

5. A method for extracting bitumen from bituminous sand comprising:

(a) maintaining a vertically extending packed bed of bituminous sand in a vertically extending extraction zone and introducing bituminous sand into an upper portion of said bed;

(b) providing a substantially continuous gaseous phase in contact with a lower portion of said bed;

(c) maintaining a substantially continuous liquid phase comprising a vaporizable primary liquid solvent and at least one secondary liquid solvent in contact with at least a lower part of said upper portion of said bed above said gaseous phase, said liquid phase and said gaseous phase having an interface at a vertically intermediate level of said bed;

(d) introducing said primary liquid solvent into an intermediate liquid level in said liquid phase space from the top of said liquid phase;

(e) introducing at least one secondary liquid solvent into said liquid phase above said intermediate liquid level;

(f) extracting bitumen from said bituminous sand into said liquid phase, and removing the resulting extracted bitumen and said solvents from said extraction zone;

(g) preventing said liquid phase from flowing downwardly through said lower portion of said bed by maintaining said gaseous phase at a pressure sufficient to support said liquid phase thereon and vaporizing said primary solvent adhering to solids in said lower portion of said bed; and (h) removing solids from said lower portion of said bed.

6. A method according to claim 5 wherein said primary solvent comprises at least one hydrocarbon having a normal boiling point in the range from about 40° C. to about 90° C.

7. A method according to claim 5 wherein said secondary solvent comprises at least one hydrocarbon having a normal boiling point in the range from agbout 95° C. to about 320° C.

8. A method according to claim 5 wherein said secondary solvent includes at least 25 weight percent aromatic hydrocarbons.

* * * * *